US006734775B2

(12) United States Patent
Chung

(10) Patent No.: US 6,734,775 B2
(45) Date of Patent: May 11, 2004

(54) TRANSFORMER STRUCTURE

(76) Inventor: Yu-Lin Chung, No. 4, Lane 130, Nan-Kang Rd, Sec. 3, Taipei (TW)

( * ) Notice: Subject to any disclaimer, the term of this patent is extended or adjusted under 35 U.S.C. 154(b) by 1 day.

(21) Appl. No.: 10/135,757

(22) Filed: Apr. 29, 2002

(65) Prior Publication Data

US 2003/0201863 A1 Oct. 30, 2003

(51) Int. Cl.[7] ..... H01F 27/30
(52) U.S. Cl. ..... 336/198; 336/212; 336/192
(58) Field of Search ..... 336/192, 198, 336/200, 83, 212

(56) References Cited

U.S. PATENT DOCUMENTS 4,424,504 A * 1/1984 Mitsui et al. ..... 336/83
4,549,130 A * 10/1985 Dobberstein ..... 323/308
5,010,314 A * 4/1991 Estrov ..... 336/198
6,114,932 A * 9/2000 Wester et al. ..... 336/65
2002/0057178 A1 * 5/2002 Timashov et al. ..... 336/208

* cited by examiner

*Primary Examiner*—Anh Mai
(74) *Attorney, Agent, or Firm*—Pro-Techtor International Services

(57) ABSTRACT

An improved transformer structure mainly has a lower iron core disposed with a plastic securing seat having a central insert tube provided for the insertion of circular posts disposed respectively on an upper and the lower iron cores; a plurality of pins on the lateral sides of the plastic securing seat respectively provided for the fixing insertion of through holes on a circuit board thereby fastening a flat coil and the circuit board on the plastic securing seat so as to increase the pressure resistance value of the iron cores and the coil as well as obtain a precise positioning point of the transformer and level the pins meet the standards of Storage Module Device (SMD).

2 Claims, 2 Drawing Sheets

TRANSFORMER STRUCTURE

BACKGROUND OF THE INVENTION

1) Field of the Invention

The present invention provides an improved transformer structure, more especially, a transformer with a precise positioning point to level a pin to meet the standards of a Storage Module Device (SMD), increase the pressure resistance value of the iron cores and a coil. Two sets of the flat coils cross and superpose each other to not only increase the coupling ability but also enhance the efficiency of the transformer.

2) Description of the Prior Art

Accordingly, a regular transformer, as shown in FIGS. 1 and 2, comprises a lower iron core (a), a circuit board (a personal computer board) (b), four Mylar insulating pieces (c, d, e, f), two flat coils (g, h) and an upper lower iron core (i), wherein, the upper and the lower iron cores (i, a) are in u-shapes and respectively disposed with circular posts (il, al) connected to form a unit; the center holes (cl, bl, dl, gl, el, hl, fl) of the Mylar insulating piece (c), the circuit board (b), another Mylar insulating piece (d), the flat coil(g), another Mylar insulating piece (e), another flat coil (h) and still another Mylar insulating piece (f) are sequentially inserted on the connected circular posts (il, al) and then affixed into a mold.

However, the three sets of the Mylar insulating pieces (c, e, f) used on the abovementioned conventional transformer are unable to be positioned and fixed. Furthermore, when the humidity raises, the contraction percentage of the Mylar insulating pieces (c, e, f) increases thereby tending to cause insufficient pressure resistance and unsteadiness; additionally, the two flat coils (g, h) are unable to be fastened with, crossed or superposed on the circuit board (b); therefore, the transformer is not very satisfactorily efficient and has less coupling ability.

In view of the abovementioned shortcomings, the inventor of the present invention developed a new and improved transformer capable of eliminating the disadvantages of the conventional product.

SUMMARY OF THE INVENTION

Therefore, the primary objective of the present invention is to provide an improved transformer structure to mainly add a plastic securing seat on a lower iron core to get a correct positioning point of the transformer, to level a pin, to meet the standards of the Storage Module Device (SMD), to increase the pressure resistance value of the iron core and a coil and to position a flat coil on a circuit board.

Another objective of the present invention is to provide an improved transformer structure to have two sets of flat wire coils cross and superpose each other to not only increase the coupling ability but also enhance the efficiency of the transformer.

To enable a further understanding of the structural features and the technical contents of the present invention, the brief description of the drawings below is followed by the detailed description of the preferred embodiment.

DETAILED DESCRIPTION OF THE PREFERRED EMBODIMENTS

Figure 1:
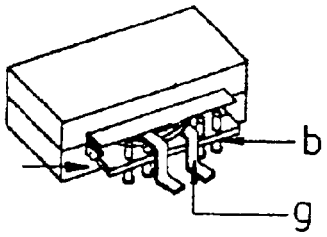
FIG.1 (PRIOR ART)
FIG. 1 is an external view drawing of a conventional product.
Figure 2:
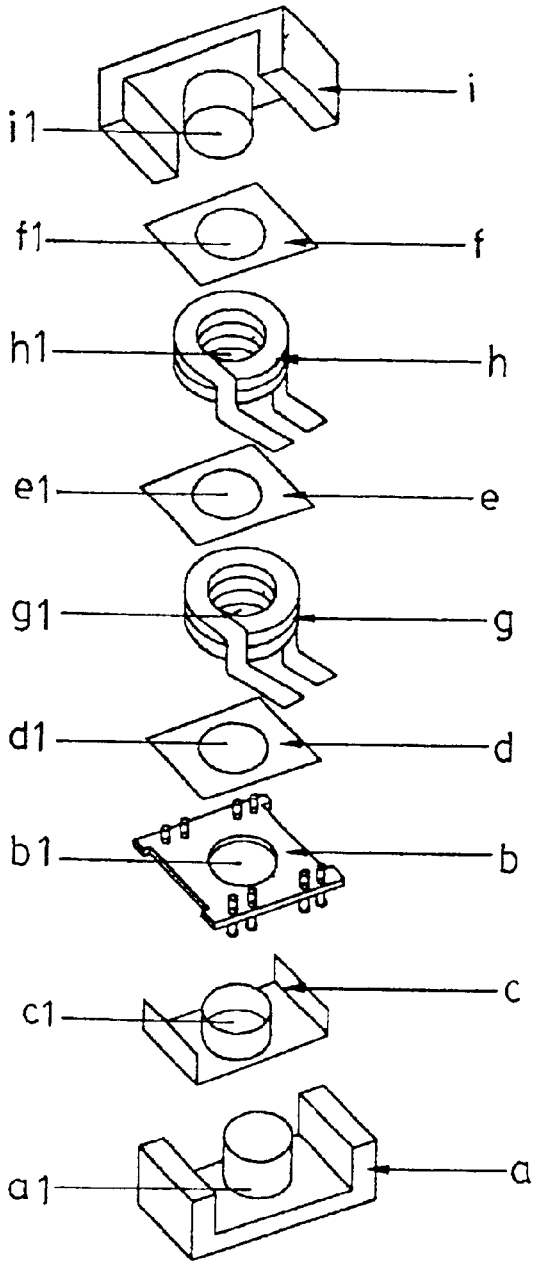
FIG.2 (PRIOR ART)
FIG. 2 is an exploded drawing of a conventional product.
Figure 3:
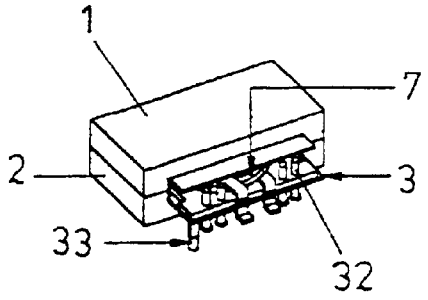
FIG. 3 is an external view drawing of the present invention.
Figure 4:
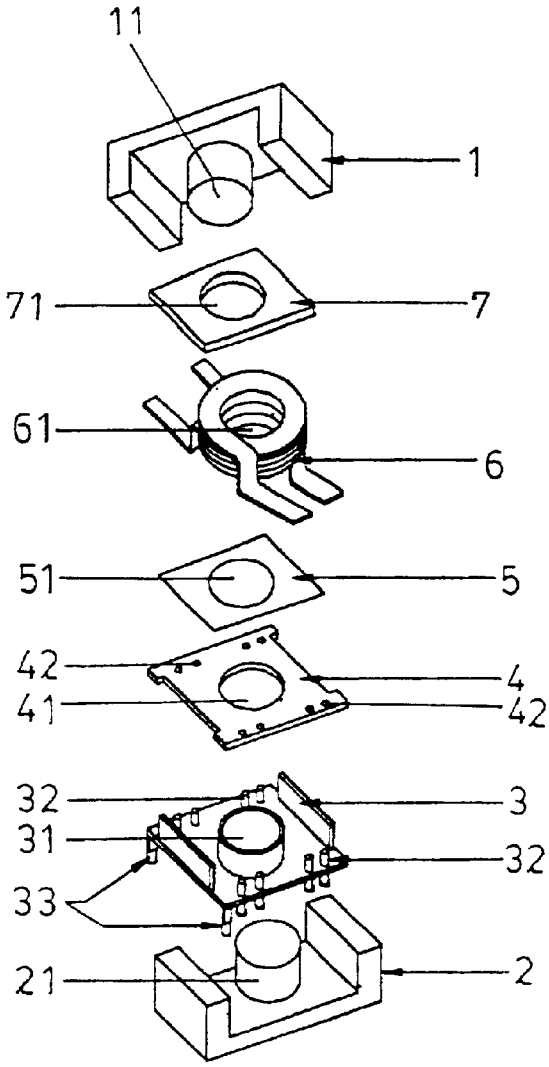
FIG. 4 is an exploded drawing of the present invention.

Referring to FIGS. 3 and 4, the present invention comprises an upper and a lower iron cores (1, 2), a plastic securing seat (3), a circuit board (4), a Mylar insulating piece (5), a flat coil (6) and a plastic insulating piece (7), wherein, the circuit board (4, personal computer board), the Mylar insulating piece (5), the flat coil (6) and the plastic insulating piece (7) are inserted between the upper and the lower iron cores (1, 2); circular posts (11, 21) are respectively disposed at the centers of the upper and lower iron cores (1, 2) for touching and connecting each other; the central holes (41, 51, 61, 71) of the circuit board (4), the Mylar insulating piece (5), the flat coil (6) and the plastic insulating piece (7) are sequentially inserted onto the circular posts (11, 21) of the upper and the lower iron cores (1, 2).

The plastic securing seat (3) is inserted on the lower iron core (2); the central insert tube (31) of the plastic securing seat (3) is provided for the insertion of the circular posts (11, 21) of the upper and the lower iron cores (1, 2). A plurality of pins (32) are disposed on proper positions on the plastic securing seat (3) for respectively inserting into a plurality of through holes (42) on the circuit board (4) thereby communicating electricity between the pins (32) and the circuit board (4); the four corner ends on the bottom portion of the plastic securing seat (3) has respective positioning points (33).

Furthermore, the flat coil (6) of the present invention is formed by crossing and superposing two sets of coils thereby increasing the coupling ability and enhancing the efficiency of the transformer. The upper aspect of the flat coil (6) is covered with a plastic insulating piece (7) instead of another Mylar insulating piece (5).

In summation of the abovementioned, the present invention of a transformation structure has improved the unable positioning problem of using Mylar insulating pieces, the situation of insufficient pressure resistance and unsteadiness due to the increased contracting percentage caused by raised temperature of a conventional transformer, and developed a plastic securing seat to obtain a correct positioning point of the transformer, level the pins, meet the standards of Storage Module Device (SMD), increase the pressure resistance value of the iron cores and the coils, position the flat wire coils on the circuit board. The two sets of the flat wire coils cross and superpose each other thereby increasing the coupling ability thereof and enhancing the efficiency of the transformer.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A transformer structure comprising an upper iron core and a lower iron core, a plastic securing seat, a circuit board, a Mylar insulating piece, a flat coil, and a plastic insulating piece; wherein circular posts disposed at centers of said upper and said lower iron cores are provided for sequential insertion of central holes of said circuit board, said Mylar insulating piece, said flat coil, and said plastic insulating piece; and wherein said plastic securing seat is disposed on said lower iron core, a central insert tube of said plastic securing seat is provided for insertion of said circular posts of said upper and lower iron cores, and a plurality of pins are disposed at proper positions on said plastic securing seat for respectively inserting into through holes on said circuit board, thereby increasing the pressure resistance value of said iron cores and said coil, obtaining a correct positioning point of said transformer, and leveling said pins.

2. A transformer structure according to claim 1, wherein said flat coil comprises two sets of coils crossed and superposed to increase the coupling ability thereof and enhance the efficiency of the transformer.

* * * * *